US007291033B2

(12) United States Patent
Hu

(10) Patent No.: US 7,291,033 B2
(45) Date of Patent: Nov. 6, 2007

(54) SNAP-ON AND SELF-LOCK RF COAXIAL CONNECTOR

(75) Inventor: Bo Hu, Xi'an (CN)

(73) Assignee: Xi'An Connector Technology, Ltd. (CNT), Xi'An (CN)

( * ) Notice: Subject to any disclaimer, the term of this patent is extended or adjusted under 35 U.S.C. 154(b) by 0 days.

(21) Appl. No.: 11/500,531

(22) Filed: Aug. 8, 2006

(65) Prior Publication Data

US 2007/0207654 A1 Sep. 6, 2007

(51) Int. Cl.
*H01R 13/625* (2006.01)

(52) U.S. Cl. ..... 439/347; 439/352; 439/843

(58) Field of Classification Search ..... 439/347, 439/843, 352, 350, 675
See application file for complete search history.

(56) References Cited

U.S. PATENT DOCUMENTS

| | | | | |
|---|---|---|---|---|
| 3,314,696 | A * | 4/1967 | Ferguson et al. | 285/148.14 |
| 3,450,424 | A * | 6/1969 | Calisher | 285/305 |
| 3,453,005 | A * | 7/1969 | Foults | 285/82 |
| 3,793,610 | A * | 2/1974 | Brishka | 439/349 |
| 3,810,073 | A * | 5/1974 | Zajac et al. | 439/352 |
| 3,885,851 | A * | 5/1975 | Bennett | 439/352 |
| 4,261,628 | A * | 4/1981 | Gallagher et al. | 439/95 |
| 4,548,455 | A * | 10/1985 | Ezure | 439/152 |
| 5,275,443 | A * | 1/1994 | Klinger | 285/82 |
| 5,653,606 | A * | 8/1997 | Chrysostomou | 439/352 |
| 5,957,716 | A * | 9/1999 | Buckley et al. | 439/321 |
| 5,992,903 | A * | 11/1999 | Bartholomew | 285/319 |
| 6,464,527 | B2 * | 10/2002 | Volpe et al. | 439/352 |
| 6,692,286 | B1 | 2/2004 | De Cet | |
| 6,692,287 | B2 * | 2/2004 | Yasuda | 439/352 |
| 6,780,042 | B1 * | 8/2004 | Badescu et al. | 439/352 |
| 6,811,422 | B1 * | 11/2004 | Muller | 439/314 |

FOREIGN PATENT DOCUMENTS

EP 1 222 717 B1 5/2001

* cited by examiner

*Primary Examiner*—Tho D. Ta
*Assistant Examiner*—Vanessa Girardi
(74) *Attorney, Agent, or Firm*—Connolly Bove Lodge & Hutz LLP

(57) ABSTRACT

The invention disclosed a RF coaxial connector. The RF coaxial connector comprises a plug connector and a jack connector that can be inserted into the plug connector. A groove is provided on an outer surface of said jack connector. Said plug connector includes a core body which defines an inner cavity therein, and an outer wall of said core body has through-grooves the depth of which are suitable to form openings in the outer wall of the core body. A spring extends through said through-grooves, and parts of said spring are exposed to the inner cavity of the core body through the openings and connected to the groove of said jack connector in a snap-on manner when said jack connector is inserted into said plug connector. A slide is disposed outside the core body and suitable to contact with said spring for releasing the snap-on connection of said spring to the jack connector. Preferably, a spring collar may be disposed within the inner cavity of said core body. This connector can be widely used in microwave equipment and digital communication device to connect coaxial cables.

12 Claims, 5 Drawing Sheets

SNAP-ON AND SELF-LOCK RF COAXIAL CONNECTOR

TECHNICAL FIELD

The invention relates to a RF coaxial connector.

BACKGROUND ART

RF coaxial connector is widely applied in modern communication device, and it can interconnect communication devices efficiently and transfer communication signals between them. The structure and performance of RF coaxial connector directly affect the quality of signal communication. SMA-series connector is a miniature coaxial connector with screw-threaded connection mechanism, and it complies with some related specifications, such as MIL-C-39012, IEC169-15, CECC22110 etc and it has some advantages such as long life, excellent performance and high reliability. Therefore, SMA-series connector is widely used to connect coaxial cables in RF circuits within microwave devices and digital communication devices. However, the interface of SMA-series connector is a screw-thread type, so it cannot achieve a snap-on connection. Although some companies take the screw-thread off in order to achieve the snap-on connection, this snap-on type of SMA-series without screw-thread is only suitable for experimental test, not for actual work.

SUMMARY OF THE INVENTION

The invention aims to provide a RF coaxial connector which has a snap-on and self-lock performance.

The RF coaxial connector according to this invention comprises a plug connector and a jack connector that can be inserted into the plug connector. A groove is provided on an outer surface of said jack connector. Said plug connector includes a core body which defines an inner cavity therein, and an outer wall of said core body has two through-grooves, the depth of which are suitable to form openings in the outer wall of the core body. A spring extends through said through-grooves, and parts of said spring are exposed to the inner cavity of the core body through the openings and connected to the groove of said jack connector in a snap-on manner when said jack connector is inserted into said plug connector. A slide is disposed outside the core body and suitable to contact with said spring for releasing the snap-on connection of said spring to the jack connector. Preferably, a spring collar may be disposed within the inner cavity of said core body.

In the present invention, due to the cooperation of the spring of the plug connector and the groove of the jack connector, The RF coaxial connector can obtain a snap-on and self-lock performance, and the mechanical connection between them is highly reliable. By disposing a spring collar within the core body, it can ensure the contact performance of the electrical connection and make the mechanical contact separated from the electrical contact. The RF coaxial connector according to this invention has not only the excellent performance and high reliability of SMA-series connector, but also a snap-on characteristic similar to SMB and MCX connector. It can be widely used in microwave equipment and digital communication device to connect coaxial cables.

PREFERRED EMBODIMENTS

Figure 1:
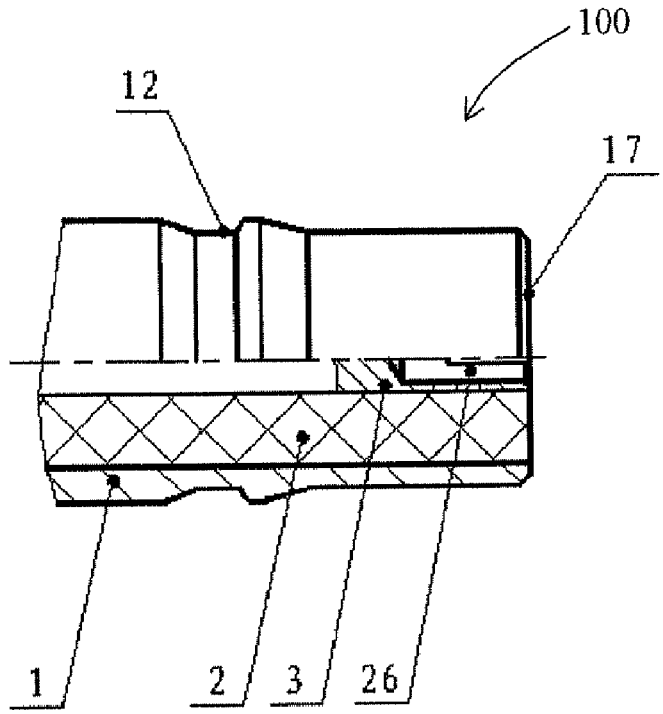
FIG. 1 is a half-sectional view of the jack connector.

As shown in the drawings, a RF coaxial connector comprises separated jack connector 100 and plug connector 200. The jack connector 100 can be inserted into the plug connector 200 to connect them and also can be pulled out from plug connector 200 to disconnect them.

FIG. 1 shows the structure of jack connector 100. The jack connector 100 comprises a generally cylindrical housing 1. A cylindrical isolator 2 is disposed along the inner wall of the housing 1. A socket body 3 is located inside the isolator 2 and defines a socket 26 therein. The socket 26 goes through an end 17 of the housing 1. A ring groove 12 is formed in the outer wall of the housing 1 along the circumference of the housing 1 so that the ring groove 12 is surrounding said housing 1. The ring groove 12 is used for the snap-on connection with a U-shaped spring 5 in the plug connector 200 when the jack connector 100 is inserted into the plug connector 200, as will be described hereinafter.

Figure 2:
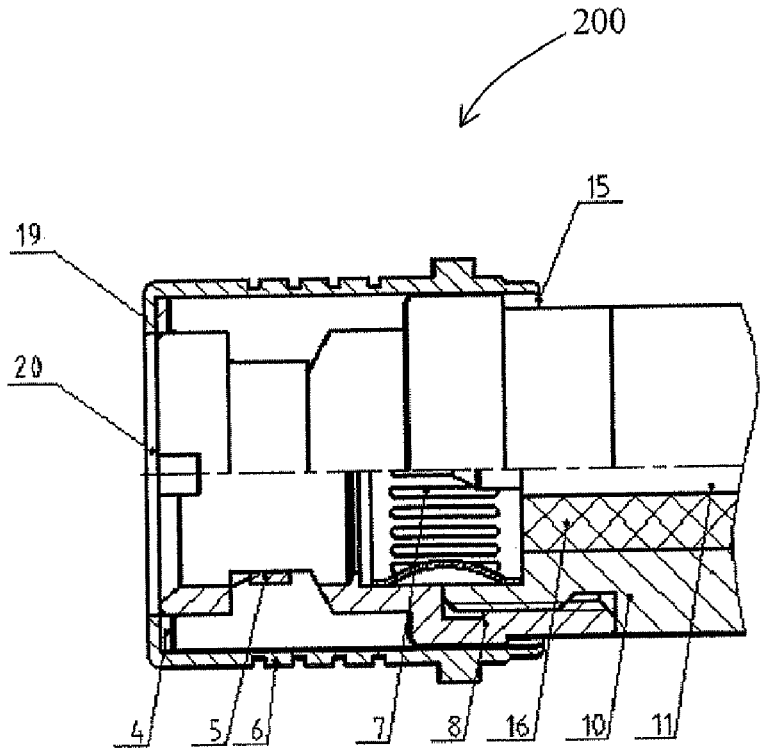
FIG. 2 is a half-section view of the plug connector.
Figure 4:
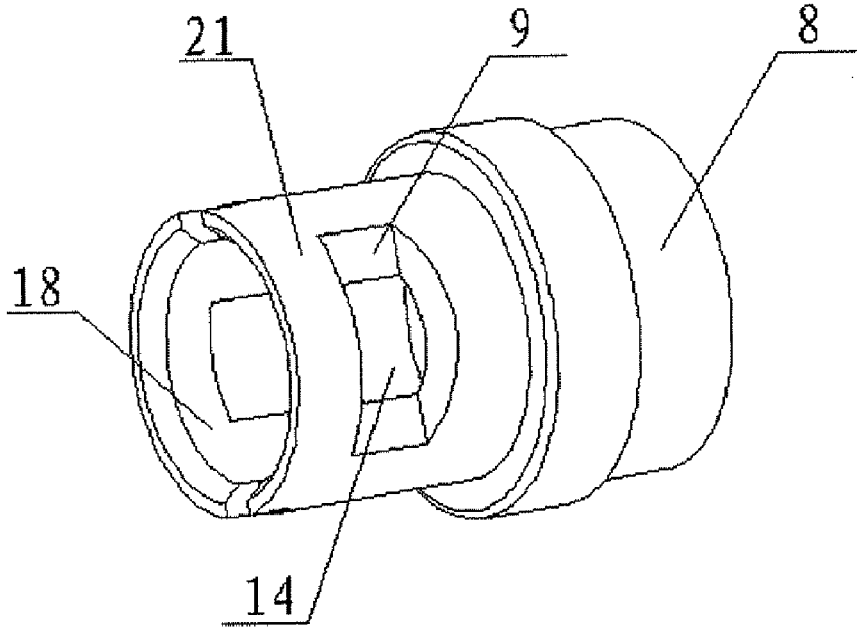
FIG. 4 is a schematic view of the core body in the plug connector.
Figure 9:
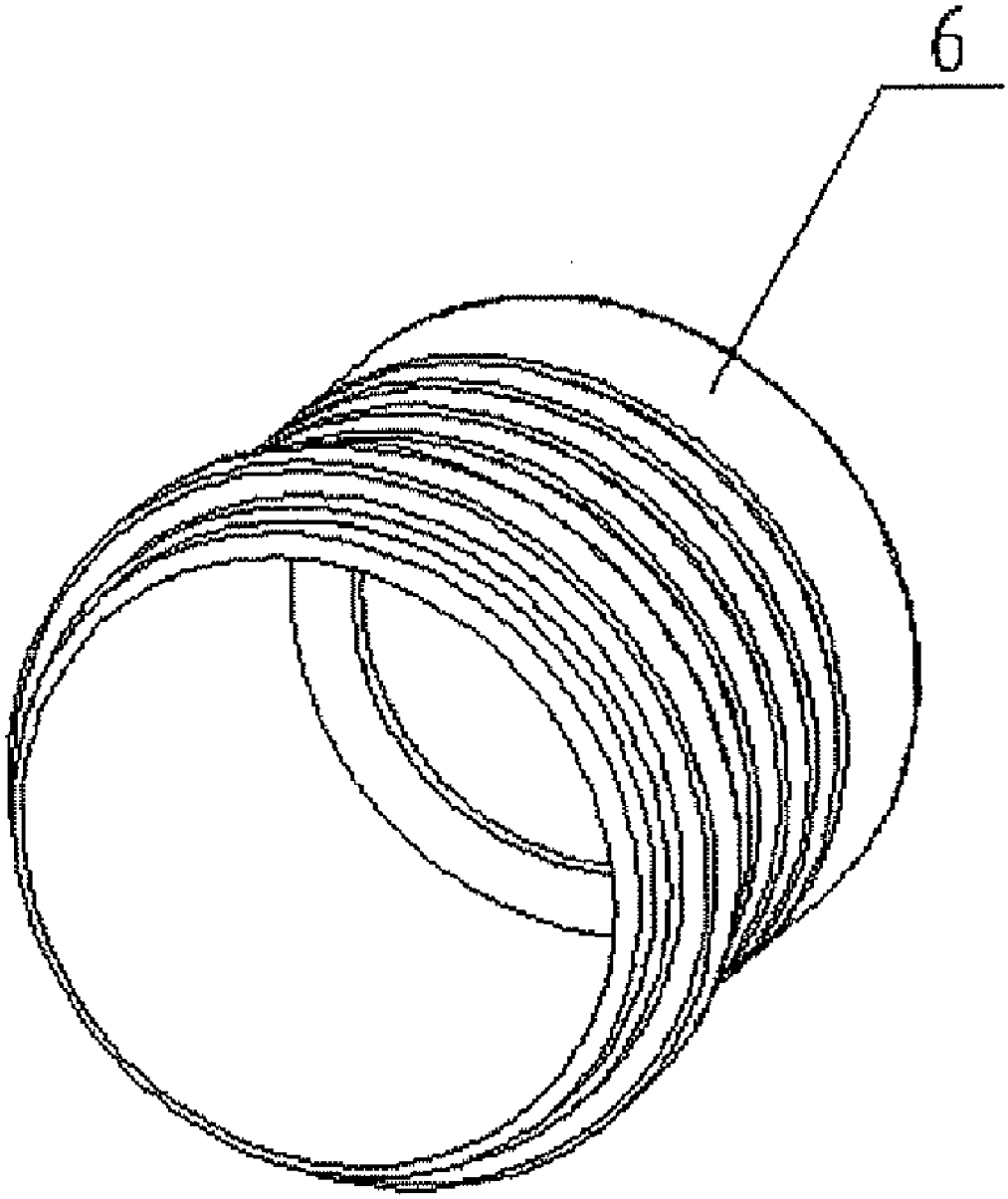
FIG. 9 is a schematic view of the housing of the plug connector.

FIG. 2 shows the structure of the plug connector 200. The plug connector 200 comprises a generally cylindrical metal housing 6 (FIG. 9) and a core body 8 (FIG. 4) contained within the housing 6. The housing 6 has an end wall 19 at an end thereof, and the end wall 19 has an opening 20 through which the jack connector 100 passes when connecting. As shown in FIG. 4, the core body 8 is generally cylindrical as well and defines an inner cavity 18. Two through-grooves 9 are provided in the outer wall 21 of the core body 8 along the circumference of core body 8, and the two through-grooves 9 are diametrically opposite and parallel with each other. The depth of the through-grooves 9 is selected such that they can form openings 14 in the wall of the core body 8. Back to FIG. 2, a shell 10 is connected to the core body 8 at an end thereof by means of an external screw-threaded connection. A cylindrical isolator 16 is arranged in the shell 10 and a pin 11 is disposed inside the isolator 16. When the jack connector 100 is inserted into the plug connector 200, the pin 11 is inserted into the socket 26 of the jack connector 100.

Figure 7:
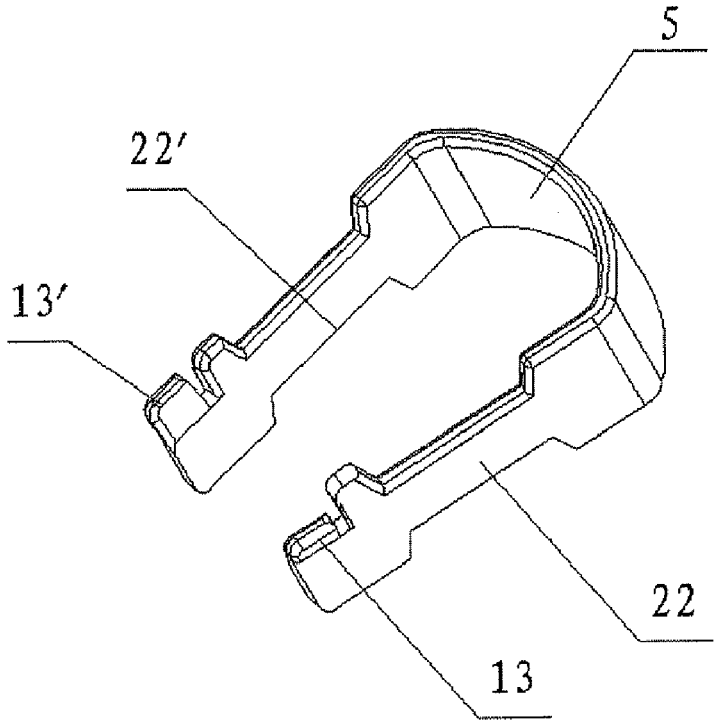
FIG. 7 is a schematic view of the U-shaped spring in plug connector.
Figure 8:
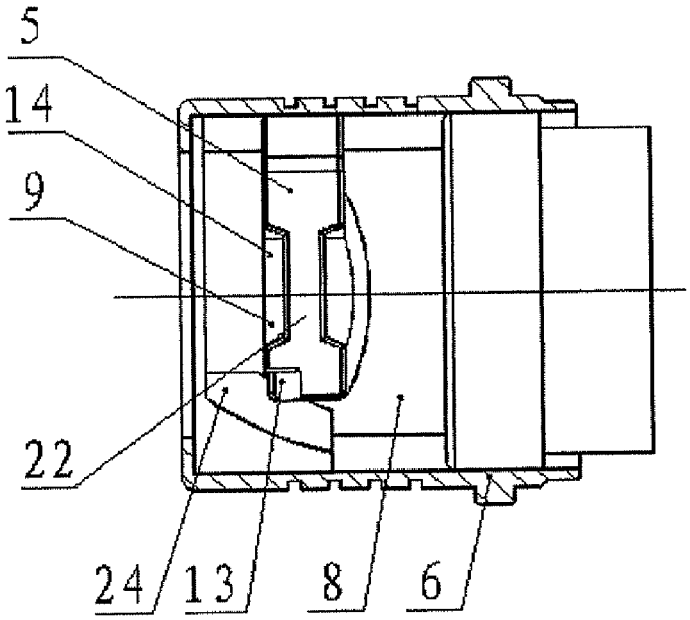
FIG. 8 is a schematic structure view showing the cooperation of the slide and the spring.

Referring to FIGS. 2, 7 and 8, the plug connector 200 further comprises a U-shaped spring 5 having two legs 22 and 22'. The U-shaped spring 5 clips on the outer wall 21 of the core body 8 and its two legs 22 and 22' extend through the two through-grooves 9 respectively. Obviously, when this U-shaped spring 5 is mounted on the core body 8, the approximate middle sections of the two legs 22 and 22', which face the openings 14, are exposed to the inner cavity 18 of the core body 8 through the openings 14. Therefore, when the jack connector 100 is inserted into the inner cavity 18 of the plug connector 200, the middle sections of two legs 22 and 22' can be embedded into the ring groove 12 of the jack connector 100. Thus, the self-lock of the jack connector 100 to the plug connector 200 can be achieved.

Figure 6:
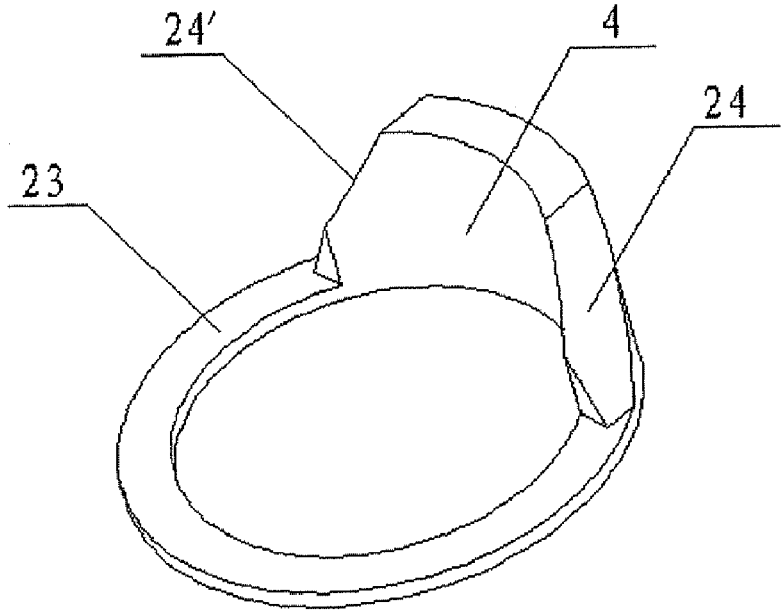
FIG. 6 is a schematic view of the slide and the actuating element in the plug connector.

Referring to FIGS. 2, 6 and 8, a slide 4 is positioned between the outer wall 21 of the core body 8 and the housing 6, and the slide 4 can be movable smoothly along the axial direction of the plug connector 200. In the assembled state, the slide 4 is located between the end wall 19 of the housing 6 and the U-shaped spring 5, and suitable for being inserted into a space between the free ends of the two legs 22 and 22' of the U-shaped spring 5 through axial movement. When the jack connector 100 needs to be pulled out from the plug connector 200, the slide 4 can be slipped and inserted into the space between the free ends of the two legs 22 and 22' so that the two legs 22 and 22' can be splayed outwards. As a result, the snap-on connection of the U-shaped spring 5 to the ring groove 12 can be released.

In order to axially move the slide 4, an actuating element 23 is connected to the slide 4. For example, as shown in FIG. 6, the actuating element 23 can be a ring, and the actuating element 23 and the slide 4 can be formed as one piece. The ring 23 is substantially vertical to the extending direction of the slide 4. In the assembled state, the ring 23 is arranged to be parallel with the end wall 19 of the housing 6 and to abut against the end wall 19. When pulling the jack connector 100 out from the plug connector 200, an operator pushes the housing 6 in the axial direction with his hand, the end wall 19 of the housing 6 pressing the ring 23 to advance axially, then the ring 23 in turn driving the slide 4 to move axially, eventually the slide 4 splaying the two legs 22 and 22' of U-shaped spring 5 outwards.

In order to facilitate the slide 4 to be inserted between the free ends of two legs 22 and 22' of the U-shaped spring 5, the slide 4 is tapered toward its end. Furthermore, the slide 4 had two side surfaces 24 and 24' that are inclined, and the free end of each leg 22, 22' of the U-shaped spring 5 has a wing 13, 13' extending outwards. As shown in FIG. 8, during inserting the slide 4, the two wings 13 and 13' cooperate with the two inclined surfaces 24 and 24' of the slide 4 by contact, respectively.

Figure 5:
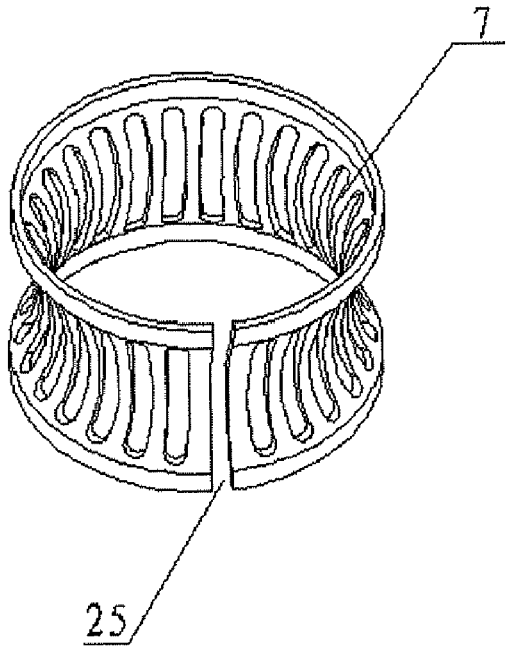
FIG. 5 is a schematic view of the spring collar in plug connector.

Additionally, as shown in FIG. 2 and FIG. 5, a ring spring collar 7 can be accommodated in the inner cavity 18 of the core body 8 and it preferably has an arc-shaped surface. When the jack connector 100 is inserted into the plug connector 200, the ring spring collar 7 surrounds and presses against the housing 1 of the jack connector 100. The ring spring collar 7 preferably has an opening 25 for enhancing its radial retractility. The ring spring collar 7 is used to ensure a reliable electrical contact between the jack connector 100 and the plug connector 200.

Figure 3:
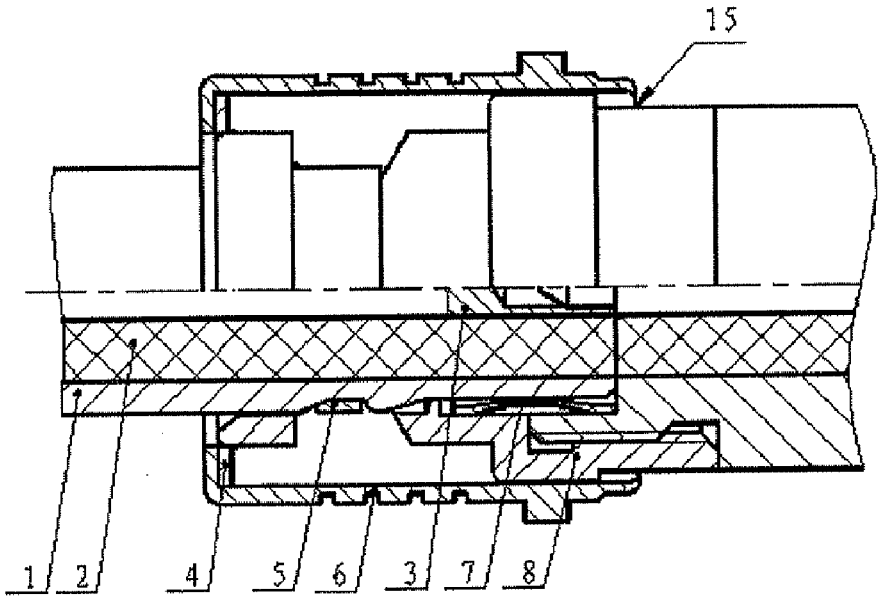
FIG. 3 is a schematic connection state of the plug connector and the jack connector.

When assembly, firstly, placing the spring collar 7 into the shell 10, then connecting the core body 8 to the shell 10 by means of screw thread, and snapping the U-shaped spring 5 into the through-grooves 9 of the core body 8. Next, placing the slide 4 into the housing 6, and then aligning the wings 13 and 13' of two legs 22 and 22' of U-shaped spring 5 to the inclined surfaces 24 and 24' of the slide 4. Thus, the core body 8 and the U-shaped spring 5 can be pushed into the housing 6 together, which simultaneously press the ring actuating element 23 of the slide 4 against the end wall 19 of the housing 6. Last, a shrink is formed at the position indicated by 15, as shown in FIG. 3. When the jack connector 100 has been inserted, a portion of each leg 22, 22' of the U-shaped spring 5 goes though the opening 14 of the core body 8 to snap onto the groove 12 of the jack connector housing 1. As a result, a self-lock can be achieved and prevents the jack connector from being pulled out from the plug connector.

After the housing 1 of the jack connector 100 has been inserted into the plug connector 200, the outer wall of the housing 1 contacts tightly with the spring collar 7 at the smallest diameter of the spring collar 7. The arc-shaped surface of the spring collar 7 pressed the outer wall of the housing 1 by means of its elasticity, which ensures the good contact between the plug and jack connectors connected together. It also ensures a high reliability of mating and a small contact resistance.

When pulling the jack connector 100 out, it just needs a little pressure to push the housing 6 inwards along the axial direction. At the same time, the end wall 19 of the housing 6 pushes the ring 23 to advance in the axial direction, and the ring 23 in turn drives the slide 4 to move axially. Two inclined surfaces 24 and 24' of the slide 4 press the two wings 13 and 13' of the U-shaped spring 5 to splay the two legs 22 and 22' of the U-shaped spring 5, which causes the U-shaped spring 5 is disengaged from the groove 12 of the housing 1 of the jack connector. As a result, the jack connector 100 can be pulled out from plug connector 200 easily.

The invention claimed is:

1. A RF coaxial connector comprising a plug connector (200) and a jack connector (100) that can be inserted into the plug connector (200), characterized in that a groove (12) is provided on an outer surface of said jack connector (100), said plug connector (200) includes a core body (8) which defines an inner cavity (18) therein, and an outer wall (21) of said core body (8) has through-grooves (9) the depth of which are suitable to form openings (14) in the outer wall (21) of the core body (8), a spring (5) extends through said through-grooves (9), and parts of said spring (5) are exposed to the inner cavity (18) of the core body (8) through the openings (14) and connected to the groove (12) of said jack connector (100) in a snap-on manner when said jack connector (100) is inserted into said plug connector (200), a slide (4) is disposed outside the core body (8) and suitable to contact with said spring (5) for releasing the snap-on connection of said spring (5) to the jack connector.

2. The RF coaxial connector of claim 1, characterized in that said jack connector (100) comprises a housing (1), and said groove (12) is a ring groove which is surrounding the outer wall of said housing (1).

3. The RF coaxial connector of claim 1, characterized in that there are two through-grooves (9) which extend along the circumference of core body (8), and said two through-grooves (9) are diametrically opposite and parallel with each other.

4. The RF coaxial connector of claim 3, characterized in that said spring (5) is a U-shaped spring having two legs (22, 22') which extend through said two through-grooves (9) respectively, and said slide (4) is suitable to be inserted between said two legs (22, 22') to splay said U-shaped spring.

5. The RF coaxial connector of claim 4, characterized in that a part of each leg (22, 22') which faces the respective opening (14) exposes to the inner cavity (18) of said body core (8) through the respective opening (14).

6. The RF coaxial connector of claim 4, characterized in that said slide (4) is tapered toward its end, and both side surfaces (24, 24') of said slide (4) are inclined;

two wings (13, 13') are provided at the free ends of the two legs (22, 22') of said U-shaped spring (5) and extend outwards, said two wings (13, 13') cooperate with the two inclined surfaces (24, 24') of the said slide (4) by contact.

7. The RF coaxial connector of claim 1, characterized in that said plug connector (200) comprises a housing (6) which has an end wall (19) at an end thereof, said core body (8) is disposed within the housing (6), and said slide (4) is located between said housing (6) and said core body (8).

8. The RF coaxial connector of claim 7, further comprising an actuating element (23) connected to said slide (4).

9. The RF coaxial connector of claim 7, characterized in that the said actuating element (23) is a ring which is disposed parallel with the end wall (19) and abut against the end wall (19).

10. The RF coaxial connector of claim 9, characterized in that said ring and said slide (4) are formed as one piece.

11. The RF coaxial connector of claim 1, further comprising a ring spring collar (7) disposed within the inner cavity (18) of said core body (8).

12. The RF coaxial connector of claim 11, characterized in that said ring spring collar (7) has an opening (25).

* * * * *

UNITED STATES PATENT AND TRADEMARK OFFICE

CERTIFICATE OF CORRECTION

PATENT NO. : 7,291,033 B2
APPLICATION NO. : 11/500531
DATED : November 6, 2007
INVENTOR(S) : Bo Hu It is certified that error appears in the above-identified patent and that said Letters Patent is hereby corrected as shown below:

In Claim 9, in column 5, "The RF coaxial connector of claim 7" should read --The RF coaxial connector of claim 8--.

Signed and Sealed this

Eighth Day of April, 2008

JON W. DUDAS
*Director of the United States Patent and Trademark Office*